United States Patent [19]

Coleman

[11] Patent Number: 5,060,826

[45] Date of Patent: Oct. 29, 1991

[54] CONTAINER WITH INFLATABLE VESSEL FOR CONTROLLING FLOW OF LIQUID OR VISCOUS MATERIAL

[75] Inventor: Clarence B. Coleman, San Leandro, Calif.

[73] Assignee: Fabricated Metals, Inc., San Leandro, Calif.

[21] Appl. No.: 235,979

[22] Filed: Aug. 25, 1988

[51] Int. Cl.[5] ..... B67D 5/54

[52] U.S. Cl. ..... 222/95; 222/105; 222/386.5

[58] Field of Search ..... 222/95, 105, 386.5; 220/85 S

[56] References Cited

U.S. PATENT DOCUMENTS

| | | | |
|---|---|---|---|
| 3,162,328 | 12/1964 | Frume | 222/176 |
| 3,265,254 | 8/1966 | Carter et al. | 222/386.5 |
| 3,282,473 | 11/1966 | Moore | 222/95 X |
| 3,417,901 | 12/1968 | Sands | 222/95 |
| 3,494,509 | 2/1970 | McGuire | 222/95 X |
| 3,781,942 | 1/1974 | Coleman | 15/246.5 |
| 4,109,831 | 8/1978 | Culpepper et al. | 222/254 |
| 4,213,545 | 7/1980 | Thompson et al. | 222/386.5 |
| 4,280,637 | 7/1981 | Runciman | 222/95 X |
| 4,577,783 | 3/1986 | Racca et al. | 222/386.5 |
| 4,739,903 | 4/1988 | Bedwell et al. | 222/95 |

FOREIGN PATENT DOCUMENTS

| | | |
|---|---|---|
| 0206195 | 12/1986 | European Pat. Off. . |
| 2731448 | 1/1978 | Fed. Rep. of Germany . |

*Primary Examiner*—John Rivell

*Attorney, Agent, or Firm*—Jack M. Wiseman

[57] ABSTRACT

A bulk material container in which is disposed an inflatable vessel. Also disposed in the container above the inflatable vessel is a compressible vessel containing a product to be disposed. Between the inflatable vessel and the compressible vessel is disposed a generally rigid disc. A source of air under pressure disposed exteriorly of the container communicates with the inflatable vessel. As air under pressure is discharged into the inflatable vessel, the inflatable vessel expands to lift the disc vertically within the container. This action causes the compressible vessel to be compressed for dispensing the product from the compressible vessel.

6 Claims, 2 Drawing Sheets fig_5
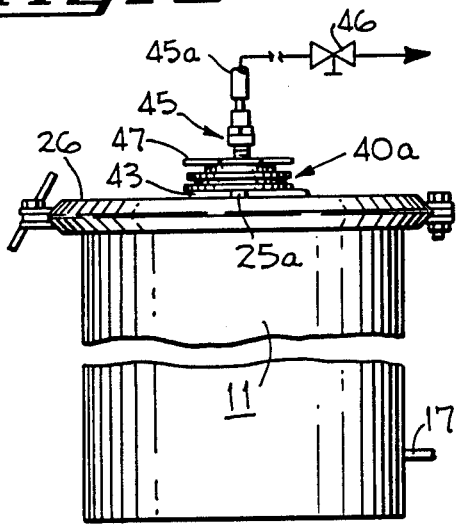
fig_6
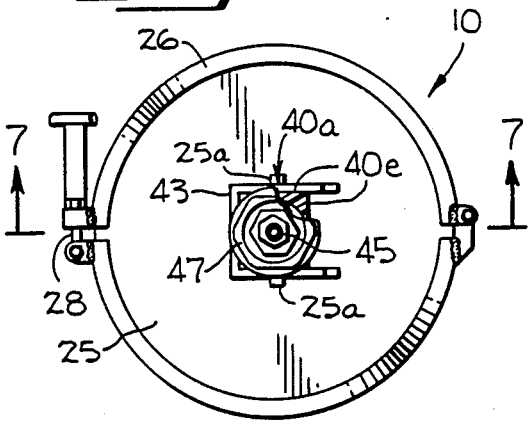
fig_8
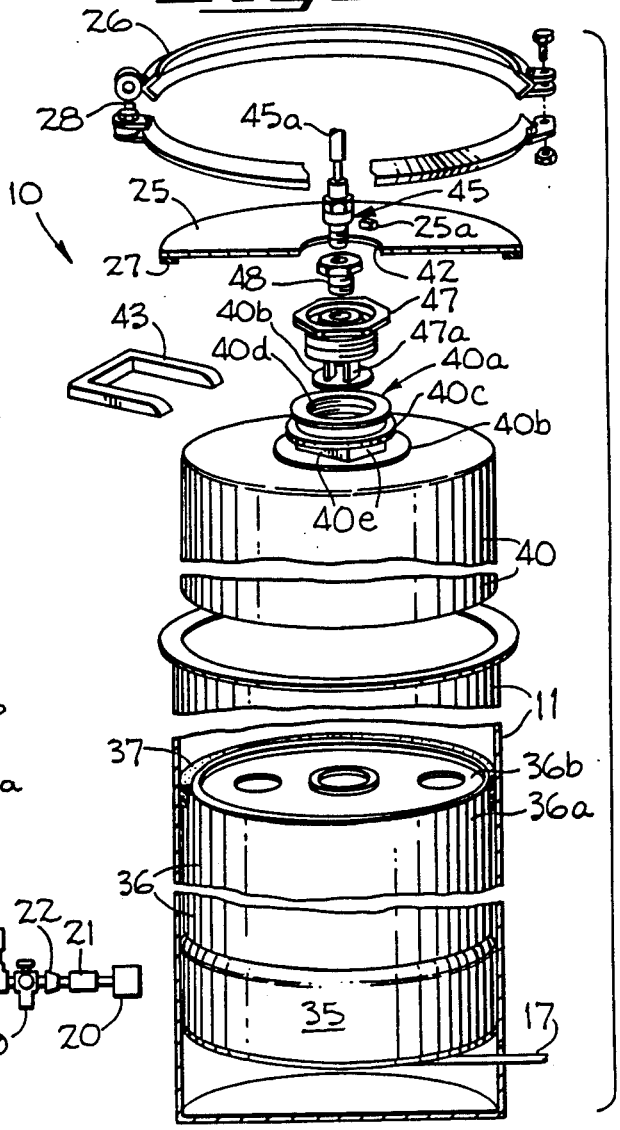
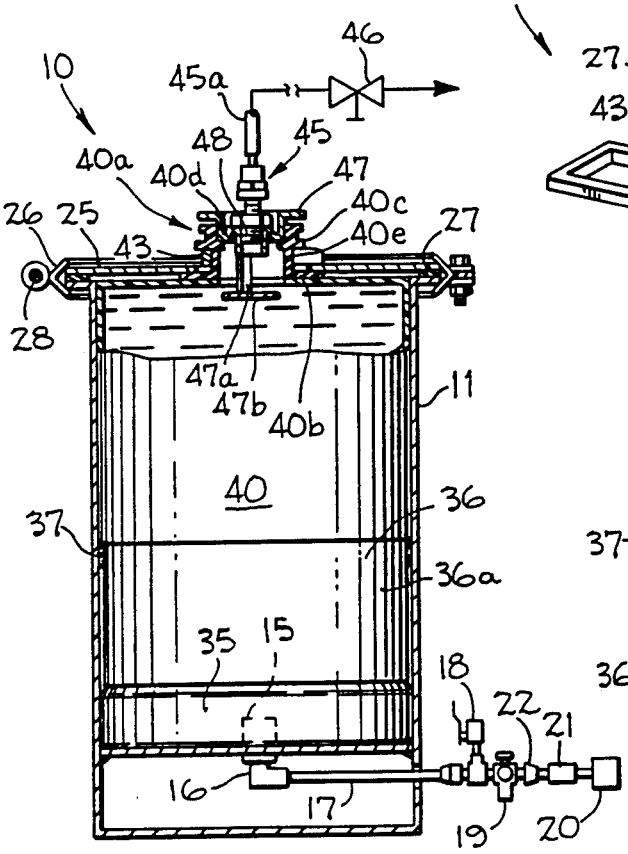
fig_7

CONTAINER WITH INFLATABLE VESSEL FOR CONTROLLING FLOW OF LIQUID OR VISCOUS MATERIAL

BACKGROUND OF THE INVENTION

The present invention relates in general to bulk material containers, and more particularly to a container for liquid or viscous material in which control is exercised over the discharge rate of the liquid or viscous material from the container.

The U.S. Pat. No. 3,417,901, to Sands, issued on Dec. 24. 1968, for Reusable Pressurized Dispensing Device, discloses a dispenser. Disposed at the bottom of the dispenser is a sealed propellant bag filled with an expansion gas, such as freon. Seated on top of the propellant bag is a product bag. The product bag includes a neck fitted to a discharge valve. As the gas in the propellant bag is brought to an operating temperature, the propellant bag expands to compress the product bag forcing the material stored therein to be discharged through the discharge valve. Liquifying the gas stored in the propellant bag causes the propellant bag to deflate.

The U.S. Pat. No. 4,109,831, to Culpepper, et al., issued on Aug. 29, 1978, for Portable Self-Contained Lubricating Apparatus, discloses a lubricant contained in bulk in the outer container. The lubricant is discharged from the bottom of the outer container. A flexible bladder is disposed in the outer container above the lubricant. Air is introduced into the bladder to expand the bladder for aiding in the discharge of the lubricant from the outer container by applying a pressure thereagainst.

The U.S. Pat. No. 3,265,254, to Carter, et al., issued on Aug. 9, 1966, for Stacked Barrels Containing Collapsible Bags, disclosed a fluid-tight container. A collapsible bag containing a beverage is disposed within a container and rests on a fixedly positioned division plate. The neck of the bag communicates with a dispenser-valve unit. Pressurized air is introduced into the air tight container below the division plate. The air under pressure is applied to the bag and compresses the bag to dispense a beverage through the dispenser-valve unit at the top of the air tight container.

The U.S. Pat. No. 3,162,328, to Frume, issued on Dec. 22, 1964, for Dispenser For Semi-Inert Fluid Material, discloses a flexible cone containing mixed mortar disposed within a cylindrical housing. At the top of the housing is a cover which has a discharge nozzle. At the bottom of the housing is an airflow regulator valve to regulate the air under pressure flowing into the housing below the flexible cone. As air under pressure is admitted into the housing, it acts against the flexible cone to force the cone upwardly within the container for the discharge of mortar in the cone through the discharge nozzle.

The U.S. Pat. No. 4,577,783, to Racca et al., issued on Mar. 25, 1986 for Dispenser, discloses a container with an outlet valve at the bottom of the container through which passes fluid material stored in the container. A follower plate contacting the fluid material forces the fluid material out of the container through the outlet valve. The U.S. Pat. No. 3,781,942, to Coleman, issued on Jan. 1, 1974, for Follower For Material Container, discloses a bulk material container for storing viscous material in which container is a flexible follower. At the bottom of the container is a discharge outlet. The flexible follower is used in the withdrawing of the viscous material from the bulk material container.

SUMMARY OF THE INVENTION

A bulk material container comprising a shell. An inflatable vessel is disposed in the shell in communication with a source of fluid under pressure. Also disposed within the shell is a compressible vessel containing a product to be dispensed. The compressible vessel communicates with a product dispensing outlet of the shell. Fluid under pressure is introduced into the inflatable vessel causing the inflatable vessel to expand. The expansion of the inflatable vessel forces the product contained in the compressible vessel to be discharged through the product dispensing outlet of the container.

An object of the present invention is to reduce product contamination.

Another object of the present invention is to minimize inherent problems for containers handling hazardous materials.

Another object of the present invention is to facilitate the dispensing of bulk material, such as fluid and viscous material.

A feature of the present invention is that the compressible vessel containing a product to be dispensed is shipped as a separate unit and is disposed in the container at the site of the container. After the product is dispensed from the compressible vessel, the compressible vessel is removed to be replaced by another compressible vessel containing a product to be dispensed.

Another feature of the present invention is that the outlet of the compressible vessel is opened and the outlet of the compressible vessel is extended through an opening in the cover of the container to establish a sealed connection with a product dispensing unit disposed exteriorly of the container.

Another feature of the present invention is the employment of a generally rigid member disposed between the inflatable vessel and the compressible vessel to serve as a piston within the container for controlling the flow of the product from the compressible vessel as the inflatable vessel expands and to assure a complete evacuation of the product from the compressible vessel.

Another feature of the present invention is the ability to dispose of a product container made of compressible material, such as polyethylene or vinyl, and thus avoid the inherent problems of disposing of a rigid container, such as aluminum or steel, when the product involved presents a hazardous waste problem.

Another feature of the present invention is the elimination of the need for an air tight container in controlling the flow of discharge of a product from a compressible vessel.

Another feature of the present invention is the employment of an inflatable vessel to compress a product vessel for dispensing the product at a controlled rate, which inflatable vessel is expanded by a regulated source of fluid under pressure.

Another feature of the present invention is that the compressible vessel extends through the cover of the container, thus enabling the compressible vessel, the cover and a locking ring for the container to remain in place, to be assembled or to be removed without removing the shipping seal on the compressible vessel. Hence, the product to be dispensed is contained in the sealed container without being subject to contamination.

Another feature of the present invention is the generally total evacuation of the product to be dispensed from the compressible vessel.

BRIEF DESCRIPTION OF THE DRAWINGS

FIG. 5 is a fragmentary elevation view of the bulk material container illustrated in FIGS. 1–4 shown with the shipping plug removed from the compressible vessel and with a dispensing tube inserted in the neck of the compressible vessel which neck extends through an opening in the cover of the bulk material container.

FIG. 6 is a plan view of the bulk material container as shown in FIG. 5.

FIG. 7 is an axial sectional view of the bulk material container as shown in FIGS. 5 and 6 taken along line 7—7 of FIG. 6.

FIG. 8 is a fragmentary exploded view partially in section of the bulk material container as shown in FIGS. 5–7.

DESCRIPTION OF THE PREFERRED EMBODIMENT

Illustrated in FIGS. 1–8 is a bulk material container 10 embodying the present invention. The bulk material container 10 comprises a conventional bulk material shell 11 which is made of generally rigid material. In the preferred embodiment, the shell 11 is made of stainless steel.

Figure 1:
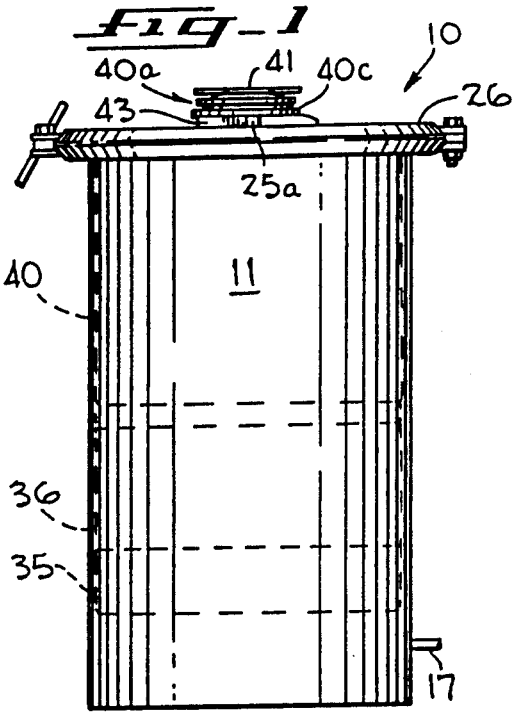
FIG. 1 is an elevation view of a bulk material container embodying the present invention shown with a shipping plug inserted in a compressible vessel.
Figure 2:
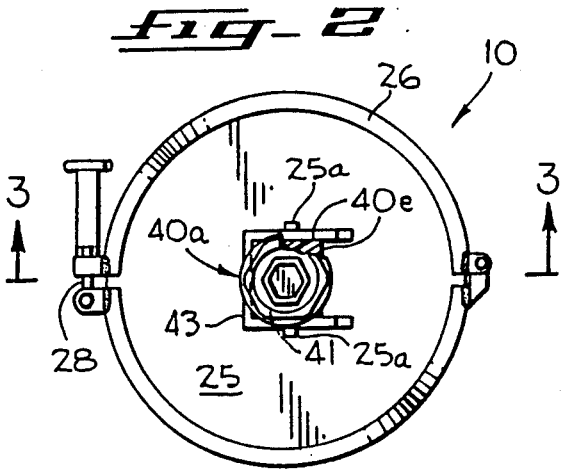
FIG. 2 is a plan view of the bulk material container shown in FIG. 1.
Figure 3:
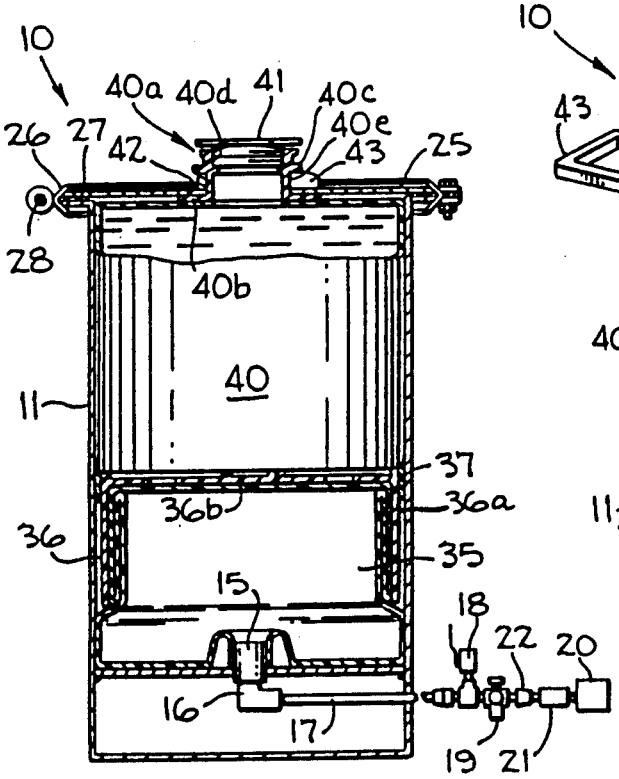
FIG. 3 is an axial sectional view of the bulk material container shown in FIGS. 1 and 2 taken along line 3—3 of FIG. 2.
Figure 4:
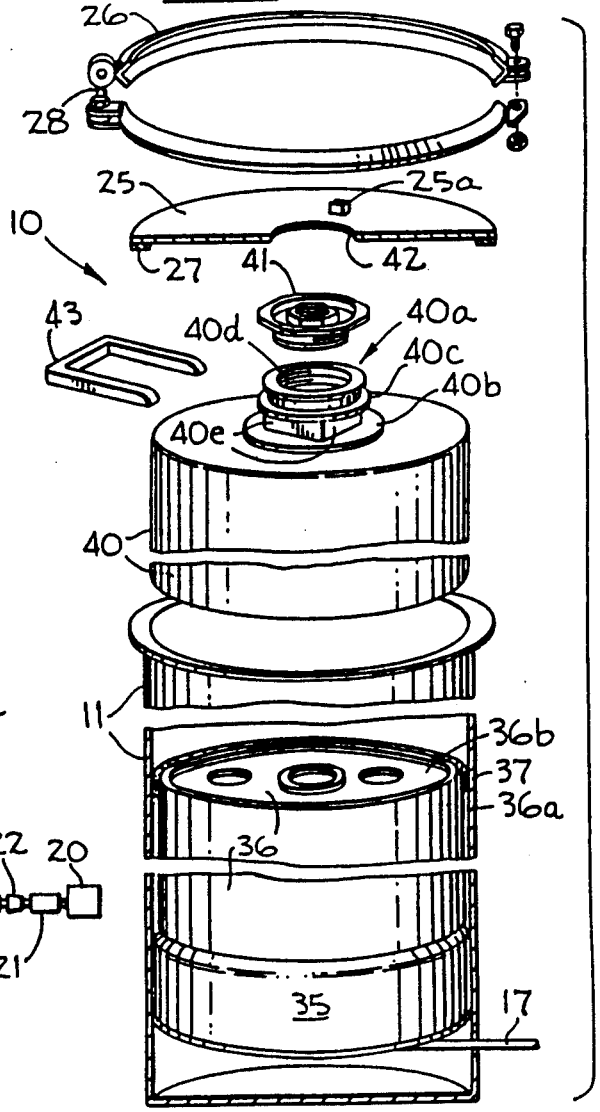
FIG. 4 is a fragmentary exploded view partially in section of the bulk material container shown in FIGS. 1–3.

At the bottom of the shell 11 is a suitable inlet opening in which is disposed in close fitting relation an adapter fitting 15 (FIGS. 3 and 7). At the inlet side of the adapter fitting 15 is an elbow 16 disposed in threaded engagement with the adapter fitting 15. A suitable conduit 17 is disposed in threaded engagement with the inlet side of the elbow 16. The outlet side of a conventional fluid or air pressure regulator 19 is disposed in threaded engagement with the conduit 17. A suitable valve 18, such as a ball valve, is disposed between the elbow 16 and the air regulator 19 in communication with the conduit 17.

A suitable source 20 of fluid or air under pressure communicates with the adapter fitting 15 through the pressure regulator 19, the conduit 17 and the elbow 16. In the preferred embodiment, the pressure regulator 19 is an air pressure regulator and is connected to a source 20 of air under pressure. In the exemplary embodiment, the pressure of the air flowing out of the air pressure regulator 19 is approximately 2 pounds per square inch. A quick connect-disconnect coupler 21 connects the source 20 of air under pressure to the air pressure regulator 19. A suitable reducer 22 is disposed between the coupler 21 and pressure regulator 19 in communication with the conduit 17.

At the top of the shell 11 is a suitable cover 25 (FIGS. 2–4 and 6–8). For removably securing the cover 25 to the shell 11 is a well-known split lock ring 26. A suitable gasket 27, such as a neoprene gasket, is disposed between the cover 25 and the perimeter of the cylindrical wall of the shell 11. The lock ring 26 has semi-annular confronting members with confronting ears. A threaded rod 28 with a suitable rotating handle is received in threaded relation with an associated nut for drawing together or separating the confronting semi-annular members of the split ring 26 for removably securing the cover 25 to the shell 11.

Disposed within the shell 11 is an inflatable, impervious vessel 35 (FIGS. 1, 3, 5, 7 and 8). In the preferred embodiment, the inflatable vessel 35 is made of a suitable plastic material. At the bottom of the inflatable vessel 35 is an inlet opening which receives the adapter fitting 15 in an air tight relation or in a close fit (FIG. 3). Disposed partially above the inflatable vessel 35, in the preferred embodiment, is a disc or piston 36. In the preferred embodiment, the disc 36 extends across the entire top wall of the inflatable vessel 35. The disc 36 is generally rigid and, in the preferred embodiment, is made of a suitable plastic material.

A spacer ring 37 is fixed to the disc 36 by a suitable adhesive material. The spacer ring 37, in the preferred embodiment, is made of a suitable material, such as sponge rubber, and engages the inner wall of the shell 11. The disc 36 and the spacer ring 37 may also be made of a light gauge metal. A cylindrical wall **36*a* depends from a flat, horizontal wall 36*b*. Suitable holes are formed in the flat, horizontal wall 36*b*. It is the horizontal flat wall 36*b* that is disposed above the inflatable vessel 35**.

In the exemplary embodiment, a compressible vessel 40 (FIGS. 3, 4, 7 and 8) for containing a product is shipped as a separate unit to the destination at which the dispensing of the product is to take place. The container 10 along with the inflatable bag 35 is generally located at the dispensing location. In the exemplary embodiment, the product stored in the product vessel 40 for dispensing is a liquid or viscous bulk material, by way of example, coloring compounds, dyes, printing ink, grease and the like. In the preferred embodiment, the product vessel 40 is pre-filled prior to shipment with the product to be dispensed. It is within the contemplation of the present invention that the product vessel 40 may be refilled without removal from the shell 11.

At the dispensing destination, the compressible vessel 40 for containing a product is unpacked from the shipping carton or the like and is disposed in the shell 11 above the disc 36. Initially, the inflatable vessel 35 is in a deflated state and the compressible vessel 40 is disposed in the shell 11 above the collapsed inflatable vessel 35. The compressible vessel 40, in the preferred embodiment, is made of suitable impervious material, such as polyethylene or vinyl. The compressible vessel 40 may be made from rubber or any other suitable flexible material.

The compressible vessel 40 is formed with a neck **40*a* through which outlet product may be dispensed. During shipment of the compressible vessel 40 a suitable plug 41 (FIGS. 1–4) closes the neck 40*a*. The neck 40*a*, in the preferred embodiment, is formed with flanges 40*b* and 40*c* and a cylindrical threaded inner wall 40*d*. In the exemplary embodiment, the outer walls of the neck 40*a* has four adjoining flat walls 40*e*. The plug 41, in the preferred embodiment, has a conforming threaded outer wall for threaded engagement with the cylindrical threaded wall 40*d* of the neck 40*a*. During the shipment of the compressible vessel 40 to the dispensing location, the plug 41 closes the orifice of the neck 40*a*. After the compressible vessel 40 reaches its dispensing location and after the compressible vessel 40 is disposed in the shell 11 for seating above the disc 36, the neck 40***a* and the plug 41 inserted therein are inserted into an opening 42 formed in the cover 25 to extend outside of the shell 11 and above the cover 25. The plug 41, in the exemplary embodiment, is made of mild steel. The plug 41 can be made of plastic or other material that is non-reactive with the product contained in the compressible vessel 40. The flange 40*b* adheres to the top wall of the compressible vessel 40 in fluid tight relation by suitable means, such as heat sealing.

After the neck 40*a* and the plug 41 have advanced through the opening 42 of the cover 25, a retainer clip 43 having a U-shaped configuration engages opposite walls 40*e* of the neck 40*a* of the product vessel 40 below the perimetric flange 40*c* thereof for holding the neck 40*a* in an upright position and to inhibit the compressible vessel 40 from turning in the shell 11 while the shipping plug is removed from the neck 40*a*. The retainer clip 43 also holds the neck 40*a* in the upright position for reinserting the shipping plug 41. The retainer clip 43 is inhibited from turning by suitable stops or abutments 25*a* on the cover 25.

After the shipping plug 41 is removed from the neck 40*a* (FIGS. 5–8), a product dispensing tube 45 is disposed in a close fit relation with the inner wall of the neck 40*a*. A suitable valve 46 is disposed in the path of flow of the product advancing through the product dispensing tube 45. The retainer clip 43 holds the neck 40*a* of the compressible vessel 40 in the upright position during the insertion of the product dispensing tube 45 into the neck 40*a* for a close fit therewith and inhibits the compressible vessel 40 from turning or rotating.

For seating the dispensing tube 45 in the neck 40*a* of the compressible vessel 40, an adapter 47 (FIGS. 7 and 8) with an externally threaded wall and an internally threaded opening therethrough is disposed in threaded engagement with threaded cylindrical wall 40*d* of the neck 40*a*. An externally threaded fitting 48 is disposed in threaded engagement with the adapter 47. The fitting 48 has an internally threaded opening which receives in threaded engagement the dispensing tube 45. The dispensing tube 45 includes a suitable union so that a discharge hose 45*a* (FIGS. 5 and 7) can be removed to allow the rotation of the adapter 47 without rotating the valve 46 and the hose 45*a*. The adapter 47 includes an upright member 47*a* and a baffle 47*b*. In this manner, the opening of the threaded fitting 48 is not closed as the vessel 40 collapses and the flow of material therethrough is not interrupted.

For dispensing the product contained in the compressible vessel 40 through the product dispensing tube 45, a regulated source of air or fluid under pressure advances through the air or fluid pressure regulator 19, the conduit 17, the elbow 16, and the fitting 15. The air or fluid under pressure then enters the collapsed inflatable vessel 35 causing the inflatable vessel 35 to expand. This action causes the disc 36 to rise within the shell 11 guided in its vertical movement by the cylindrical wall of the shell. As the disc 36 rises within the shell 11, the compressible vessel 40 is compressed forcing the product stored therein to be dispensed through the product dispensing tube 45 and the valve 46 at a controlled rate of flow commensurate with the pressure of the air or fluid inflating the inflatable vessel 35. The disc 36 assists in the ability to regulate the flow of product from the product vessel 40.

The disc 36 is guided by the cylindrical wall of the shell 11, and, hence, is lifted vertically. The guiding of the disc 36 by the wall of the shell 11 provides a constant horizontal lifting action for the disc 36, thereby an even elevating compressing action for the product vessel 40 to dispense the entire content of the product within the product vessel 40 to reduce product residue or pockets of the product remaining in the product vessel after a complete dispensing operation.

When the disc 36 reaches the maximum elevation within the shell 11, the disc 36 urges a completely compressed vessel 40 against the cover 25 and the compressed vessel 40 has completely dispensed its product. After the compressed vessel 40 has been substantially emptied, air or fluid under pressure in the inflatable vessel 35 is now discharged through the inlet 15 and the valve 18 for returning the inflatable vessel 35 to its initial deflated state (FIGS. 3 and 7). This action facilitates the removal of the compressed vessel 40 when it is empty. The valve 46 (FIGS. 5 and 7) is now closed. Thereupon, the union in the product dispensing tube 45 is removed for removing the adapter 47 from the neck 40*a* of the product vessel 40. The shipping plug 41 is reinserted into the neck 40*a* of the product vessel 40 to seal off the product vessel 40 in its compressed state. The removal of the retainer clip 43 releases the neck 40*a* of the product vessel 40. The product vessel 40 can now be removed from the shell 11 safely. The product vessel 40 is returned to its original location for refilling.

What is claimed is:

1. A bulk material container comprising:

(a) a shell;

(b) a fully enclosed, fluid tight inflatable vessel disposed in said shell, said inflatable vessel having an inlet opening:

(c) a compressible vessel in which is stored a product to be dispensed, said compressible vessel being disposed in said shell adjacent said inflatable vessel, said compressible vessel having an outlet through which passes the product to be dispensed;

(d) fitting means coupled to said inlet opening in a close fit relation and communicating with said inlet opening of said inflatable vessel for introducing fluid under pressure into said fully enclosed inflatable vessel to expand said inflatable vessel for compressing said compressible vessel to discharge the product stored in said compressible vessel for dispensing said product through said outlet of said compressible vessel;

(e) a cover seated on said shell and formed with an opening therethrough, said outlet for said compressible vessel being in the form of a neck for extending through said opening in said cover;

(f) product dispensing means communicating with said neck for dispensing said product from said compressible vessel;

(g) a plurality of stops on said cover in the vicinity of said product dispensing means, and (h) a retainer clip engaging said neck of said compressible product vessel and said product dispensing means to inhibit rotation of said compressible vessel and to hold the neck in the upright position, said compressible product vessel being restrained from rotation in response to said retainer clip engaging one of said stops.

2. A bulk material container as claimed in claim 1 and comprising a lock ring for removably securing said cover to said shell.

3. A bulk material container as claimed in claim 2 and comprising a shipping plug removably disposed in said neck in sealing engagement therewith, said shipping plug being removed from said neck to be replaced by said product dispensing means while said neck is inhibited from rotating by said retainer clip.

4. A bulk material container comprising:

(a) a shell;

(b) a fully enclosed, fluid tight inflatable vessel disposed in said shell, said inflatable vessel having an inlet opening;

(c) a compressible vessel in which is stored a product to be dispensed, said compressible vessel being disposed in said shell adjacent said inflatable vessel, said compressible vessel having an outlet through which passes the product to be dispensed;

(d) fitting means coupled to said inlet opening in a close fit relation and communicating with said inlet opening of said inflatable vessel for introducing fluid under pressure into said fully enclosed inflatable vessel to expand said inflatable vessel for compressing said compressible vessel to discharge the product stored in said compressible vessel for dispensing said product through said outlet of said compressible vessel;

(e) a relatively rigid disc interposed between said inflatable vessel for compressing said compressible vessel in response to the expansion of said inflatable vessel to dispense said product through the outlet of said compressible vessel;

(f) a cover seated on said shell and formed with an opening therethrough, said outlet for said compressible vessel being in the form of a neck for extending through said opening in said cover;

(g) product dispensing means communicating with said neck for dispensing said product from said compressible vessel;

(h) a plurality of stops on said cover in the vicinity of said product dispensing means; and (i) a retainer clip engaging said neck of said compressible vessel and said product dispensing means to inhibit rotation of said compressible vessel and to hold said neck in the upright position, said compressible product vessel being restrained from rotation in response to said retainer clip engaging one of said stops.

5. A bulk material container as claimed in claim 4 and comprising a lock ring for removably securing said cover to said shell.

6. A bulk material container as claimed in claim 5 and comprising a shipping plug removably disposed in said neck in sealing engagement therewith, said shipping plug being removed from said neck to be replaced by said product dispensing means while said neck is inhibited from rotating by said retainer clip.

* * * * *